United States Patent [19]

von Entress-Fursteneck et al.

[11] Patent Number: 4,809,613

[45] Date of Patent: Mar. 7, 1989

[54] CASING FOR AN EXPLOSIVE CHARGE

[75] Inventors: Wolfgang von Entress-Fursteneck, Leinburg; Ulrich Schleicher, Hersbruck; Bernd Konik, Nuremberg, all of Fed. Rep. of Germany

[73] Assignee: Diehl GmbH & Co., Nuremberg, Fed. Rep. of Germany

[21] Appl. No.: 103,811

[22] Filed: Oct. 1, 1987

[30] Foreign Application Priority Data

Oct. 17, 1986 [DE] Fed. Rep. of Germany ..... 3635325

[51] Int. Cl.[4] ..... F42B 15/28; F42B 13/50

[52] U.S. Cl. ..... 102/473; 102/476

[58] Field of Search ..... 102/473, 476, 293, 306; 206/3

[56] References Cited

U.S. PATENT DOCUMENTS

| | | | |
|---|---|---|---|
| H362 | 11/1987 | Madderra | 102/476 |
| 266,694 | 10/1882 | Hotchkiss | 102/473 |
| 606,440 | 6/1898 | Bennett | 102/473 |
| 789,358 | 5/1905 | Cowdrey | 102/473 |
| 1,435,773 | 11/1922 | Wilhelmi | 102/473 |
| 3,252,418 | 5/1966 | Terrioux | 102/476 |
| 3,437,036 | 4/1969 | Franzen et al. | 102/476 |
| 3,726,224 | 4/1973 | Pugh et al. | 102/476 |

FOREIGN PATENT DOCUMENTS

| | | | |
|---|---|---|---|
| 3428501 | 2/1986 | Fed. Rep. of Germany | 102/473 |

*Primary Examiner*—Deborah L. Kyle
*Assistant Examiner*—Michael J. Carone
*Attorney, Agent, or Firm*—Scully, Scott, Murphy & Presser

[57] ABSTRACT

A casing for an explosive charge, especially for an article of submunition, including a covered pouring opening arranged on a damming bottom for the casing, through which an explosive charge is poured into the casing. A plate or disc member for the pouring opening is formed on a closure cover, which disc member lies tightly within the pouring opening and extends deeply into the latter; and wherein an annular rim extending over the pouring opening is formed on the closure cover, including axially open annular groove encompassing the disc member, into which there engages an annular projection of the damming bottom.

7 Claims, 2 Drawing Sheets

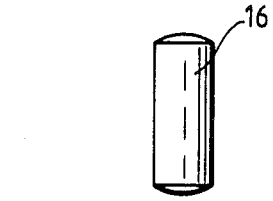
Fig.5
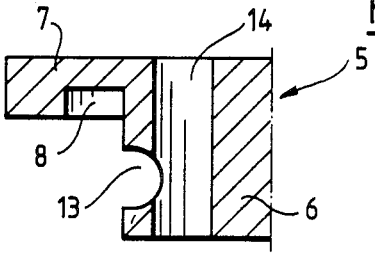
Fig.3
Fig.2
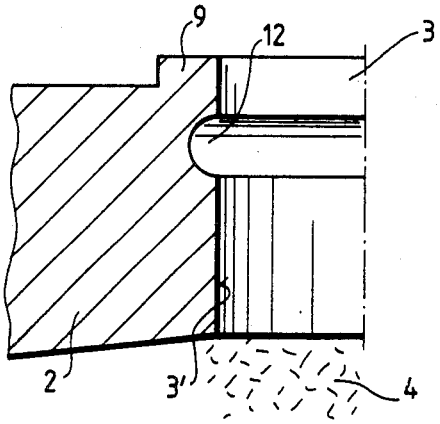
Fig.4
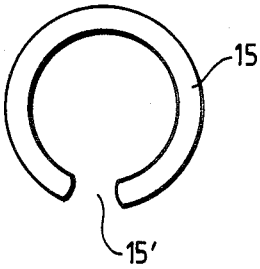

CASING FOR AN EXPLOSIVE CHARGE

BACKGROUND OF THE INVENTION

1. Field of the Invention

The present invention relates to a casing for an explosive charge, especially for an article of submunition, including a covered pouring opening arranged on a damming bottom for the casing, through which an explosive charge is poured into the casing.

2. Discussion of the Prior Art

For submunition possessing a projectile-forming explosive charge, it is necessary to provide a comparatively large-sized pouring opening for the explosive charge. The pouring opening weakens the damming bottom. During the firing of the submunition there are encountered considerable axial forces. The closure of the pouring opening must be able to withstand the effect of these axial forces.

SUMMARY OF THE INVENTION

Accordingly, it is an object of the present invention to provide a casing for an explosive charge of the above-mentioned type, in which the closure of the pouring opening stiffens the damming bottom or casing base and is able to withstand the axial forces which are generated during firing.

Inventively, the above-mentioned object is achieved in a casing for an explosive charge of the above-mentioned type in that a plate or disc member for the pouring opening is formed on a closure cover, which disc member lies tightly within the pouring opening and extends deeply into the latter; and wherein an annular rim extending over the pouring opening is formed on the closure cover, including an axially open annular groove encompassing the disc member, into which there engages an annular projection provided on the damming bottom.

Achieved through this configuration is that when the damming bottom or base exhibits a tendency to deform under the effect of the axial forces which are encountered during firing, this will cause the closure cover to be clamped fast in position. Hereby, on the one hand, there is enhanced the tight retention of the closure cover in the damming bottom and, on the other hand, the damming base is strengthened or stiffened.

BRIEF DESCRIPTION OF THE DRAWINGS

Reference may now be had to the following detailed description of exemplary embodiments of the invention, taken in conjunction with the accompanying drawings; in which:

FIG. 2 illustrates a fragmentary sectional view through a damming bottom, pursuant to a further embodiment of the invention;

FIG. 3 illustrates a fragmentary sectional view of a closure cover for the casing bottom of FIG. 2;

FIG. 4 illustrates a spring ring for the fastening in position of the closure cover of FIG. 3; and FIG. 5 illustrates a pin provided for the arresting of the spring ring of FIG. 4.

DETAILED DESCRIPTION

Figure 1:
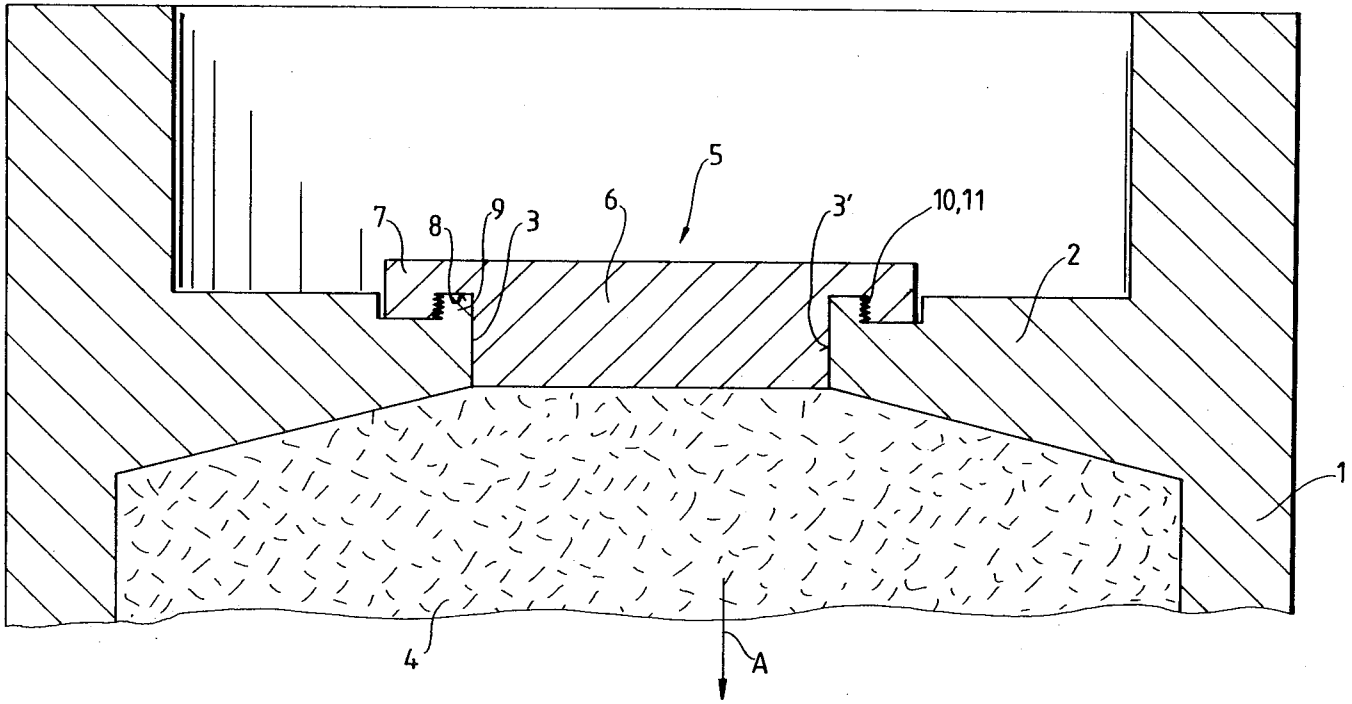
FIG. 1 illustrates a transverse sectional view through the damming bottom or base of a casing for an explosive charge, with a closure cover, pursuant to a first examplary embodiment of the invention.

A casing 1 for an explosive charge of a submunition possesses a damming bottom or base 2. The firing direction of the submunition contained in a projectile is identified by the arrow A.

A pouring opening 3 is provided in the damming base 2, through which the explosive 4 is filled into the casing 1 for the explosive charge. The pouring opening 3 is closed through the intermediary of a closure cover 5 which, preferably, is constituted from a material which is harder than that of the damming casing bottom 2.

The closure cover 5 incorporates a disc member 6. This disc member contacts closely against the edge or rim wall structure 3' of the pouring opening 3. In the embodiment pursuant to FIG. 1, the disc member 6 extends over the entire depth of the pouring opening 3. In the exemplary embodiment pursuant to FIGS. 2 through 5, the disc member 6 engages deeply into the pouring opening 3.

At the side of the closure cover 5 opposite to or facing away from the explosive material 4, the closure cover 5 is provided with an annular flange or ring-shaped rim 7 extending beyond the diameter of the pouring opening 3. On the annular rim 7 there is formed an axially open annular groove 8 which extends about the disc member 6. Engaging in close contact within the annular groove 8 is a ring-shaped projection 9 provided on the damming base 2.

In the embodiment pursuant to FIG. 1, cooperating screw threads 10, 11 are provided on the outside of the annular protuberance 9 and on the inside of the annular groove 8. The closure cover 5 is screwed to the damming casing bottom 2 by means of the cooperating screw threads 10, 11.

In the embodiment pursuant to FIGS. 2 through 5 of the drawings, a radially open groove 12 is formed about the rim or circumferential wall structure 3' of the pouring opening 3. A further radially open groove 13 is formed on the closure cover 5. The bottom of the groove 13 is intersected by a plurality of axial bores 14.

The procedure of mounting the closure cover 5 in the pouring opening 3 is carried out in somewhat the following manner:

Initially, a circlip or spring ring 15 (as shown in FIG. 4) is inserted into the groove 13. This spring ring allows itself to be secured against rotation in the groove through the intermediary of a cylindrical pin 16 which is inserted into the axial bores 14, whereby this cylindrical pin 16 engages into the gap 15' of the spring ring 15.

Thereafter, the closure cover 5 together with the spring ring 15 is inserted into the pouring opening 3. Thereby, the spring ring 15 is pressed into the groove 13. When the ring-shaped or annular protuberance 9 engages into the annular groove 8, the grooves 12, 13 will superimpose themselves, whereupon a part of the spring ring 15 will snap into the groove 12. Thereafter, cylindrical pins 16 are pressed into the bores 14, which pins will then press the spring ring 15 apart to such an extent, so that the latter has one-half of its cross-section located within the groove 12.

Under the axially acting firing load on the closure cover 5, the spring ring 15 absorbs the generated forces. Instead of the cylindrical pins 16, there can also be provided suitable screws.

The embodiment pursuant to FIGS. 2 through 5 has the added advantage, in comparison with the embodiment of FIG. 1, in that there are eliminated the screw threads 10, 11. This simplifies the manufacture and assembling procedure. The spring ring 15 can also absorb extremely high axial forces.

In both of the embodiments, it is advantageous that a deformation of the damming bottom 2 under the effect of the firing acceleration does not lead to any loosening of the seating of the closure cover 5, but in contrast therewith, has the tendency to fixedly clamp the closure cover 5.

What is claimed is:

1. Casing for an explosive charge in an article of submunition; including a damming casing bottom possessing a covered pouring opening through which an explosive charge is poured into said casing; a closure cover having a disc member provided thereon for closing of the pouring opening, said disc member extending into said pouring opening in closely-fitting contact therewith; an annular rim portion on said closure cover extending radially beyond the pouring opening, said annular rim portion including an axially open annular groove extending about the disc member; and an annular protuberance on said damming casing bottom engaging into said annular groove so as to fasten said closure cover to said casing bottom.

2. Casing for an explosive charge as claimed in claim 1, wherein said annular rim portion is located on the side of the damming base facing away from the explosive charge.

3. Casing for an explosive charge as claimed in claim 1, wherein cooperating interengageable screw threads are formed in the annular groove and on the annular protuberance.

4. Casing for an explosive charge as claimed in claim 3, wherein one of said cooperating screw threads is formed on the outside of the annular protuberance.

5. Casing for an explosive charge in an article of submunition, including a damming casing bottom possessing a covered pouring opening through which an explosive charge is poured into said casing; a closure cover having a disc member provided thereon for closing of the pouring opening, said disc member extending into said pouring opening in closely-fitting contact therewith; an annular rim portion on said closure cover extending radially beyond the pouring opening, said annular rim portion including an axially open annular groove extending about the disc member; an annular protuberance on said damming casing bottom engaging into said annular groove; a first radially open groove being formed in said disc member, and a second oppositely radially open groove being formed in said pouring opening for aligned association with said first radially open groove; and a spring ring being inserted into said grooves.

6. Casing for an explosive charge as claimed in claim 5, wherein said closure cover is constituted of a material which is harder than the material of the damming casing bottom.

7. Casing for an explosive charge as claimed in claim 5, wherein axial cylindrical pins retain the spring ring within said grooves.

* * * * *